US012655632B2

(12) United States Patent
Tompane

(10) Patent No.: US 12,655,632 B2
(45) Date of Patent: Jun. 16, 2026

(54) PREFABRICATED MODULES FOR WOOD FRAME BUILDING CONSTRUCTION

(71) Applicant: Kyle Tompane, San Diego, CA (US)

(72) Inventor: Kyle Tompane, San Diego, CA (US)

(73) Assignee: TektonOS, Inc., San Diego, CA (US)

( * ) Notice: Subject to any disclaimer, the term of this patent is extended or adjusted under 35 U.S.C. 154(b) by 495 days.

(21) Appl. No.: 17/394,737

(22) Filed: Aug. 5, 2021

(65) Prior Publication Data

US 2022/0136241 A1 May 5, 2022

Related U.S. Application Data

(63) Continuation-in-part of application No. 17/394,720, filed on Aug. 5, 2021, now Pat. No. 12,404,673.

(60) Provisional application No. 63/109,528, filed on Nov. 4, 2020, provisional application No. 63/109,525, filed on Nov. 4, 2020.

(51) Int. Cl.

| | |
|---|---|
| ***E04B 5/12*** | (2006.01) |
| ***E04B 1/26*** | (2006.01) |
| ***E04B 2/70*** | (2006.01) |
| ***E04B 7/02*** | (2006.01) |

(52) U.S. Cl.

CPC ..... *E04B 5/12* (2013.01); *E04B 1/2612* (2013.01); *E04B 2/70* (2013.01); *E04B 7/022* (2013.01)

(58) Field of Classification Search

CPC . E04B 1/2612; E04B 2/70; E04B 5/12; E04B 7/022

USPC ..... 52/633, 553.1

See application file for complete search history.

(56) References Cited

U.S. PATENT DOCUMENTS

| | | | | |
|---|---|---|---|---|
| 7,870,698 | B2 * | 1/2011 | Tonyan | E04B 1/0007 428/192 |
| 2011/0107693 | A1 * | 5/2011 | Haskell | E04C 3/14 52/204.2 |
| 2015/0110995 | A1 * | 4/2015 | Peavey | B29C 48/154 428/164 |
| 2023/0358043 | A1 * | 11/2023 | Marjaba | E04B 1/10 |

* cited by examiner

*Primary Examiner* — James J Buckle, Jr.

(74) *Attorney, Agent, or Firm* — James A. Italia; Italia IP

(57) ABSTRACT

Modules providing structural platforms for floors, ceilings, walls, and a roof of a wood frame building are shown and described. Once installed, modules receive suitable finishing materials providing continuous, flat surfaces, with exceptions for penetrations. Each module may include a wood perimeter, upper joist boards or roof rafters, coupled to the wood perimeter at relatively high positions thereon, and lower joist boards or roof rafters coupled to the bounded wood perimeter at relatively low positions thereon. Within each module, each upper joist board or upper roof rafter has a lowermost edge above a level of an uppermost edge of each said lower joist board or lower roof rafter. A gap between the lowermost edge and every lower joist board or roof rafter accommodates ducts, wiring, and plumbing. Each upper joist board or roof rafter is staggered in plan view relative to the lower joist boards or roof rafters.

4 Claims, 7 Drawing Sheets

PREFABRICATED MODULES FOR WOOD FRAME BUILDING CONSTRUCTION

CROSS-REFERENCE TO RELATED APPLICATIONS

This application relies on the disclosure of and claims priority to and the benefit of the filing date of U.S. Provisional Application Nos. 63/109,525, and 63/109,528 both of which were filed on Nov. 4, 2020, the disclosure of both is hereby incorporated by reference herein in their entirety. This application is also a Continuation in Part of U.S. Non-Provisional patent application Ser. No. 17/394,720, filed Aug. 5, 2021, is also hereby incorporated by reference.

FIELD OF THE INVENTION

The present invention relates to construction of wood frame buildings, and more particularly to modules finding utility in building wood frames for buildings.

BACKGROUND OF THE INVENTION

Construction of wood framed buildings is most commonly performed by cutting and coupling individual boards at a construction site. It is desirable to minimize labor in building construction because labor is one of the most expensive inputs in the construction process. Additionally, using human labor generates a certain amount of waste of material.

One answer to the issue of economy is the use of prefabricated modular panels, or modules. This practice is frequently used for certain generally irregular shaped components, such as triangular trusses for supporting a roof. Such components are generally large and labor intensive to build by hand Reliance on modules for building extensive platforms such as floors, ceilings, and roofs has not met with widespread commercial success.

Greater economies than currently practiced could be realized if there were practical ways to utilize modules for extensive platforms.

SUMMARY OF THE INVENTION

The present invention addresses the above stated need by proposing advantageous schemes to incorporate modules into extensive platforms, and by proposing compliant modules arranged advantageously for automated assembly procedures.

In one aspect, the present invention sets forth modules for incorporation into a frame of a wood frame building structure. The modules establish nominally flat structural platforms for expediting assembly of floors, ceilings, and a roof. These modules provide structural frames enabling appropriate finishing materials to be affixed thereto. The finishing materials provide continuous, flat surfaces, with exceptions for penetrations such as doors, windows, access passages for heating, cooling, and ventilating ducts, plumbing, wiring, and the like.

Each module may comprise a bounded wood perimeter, upper joist boards or upper roof rafters, as appropriate, coupled to the bounded wood perimeter at relatively high positions on the latter, and lower joist boards or lower roof rafters, as appropriate, coupled to the bounded wood perimeter at relatively low positions on the latter. Within each module, each upper joist board or upper roof rafter has a lowermost edge above a level of an uppermost edge of each said lower joist board or lower roof rafter. A gap exists between the lowermost edge and every lower joist board or lower roof rafter. Each upper joist board or upper roof rafter is staggered in plan view relative to the lower joist boards or lower roof rafters.

It should be noted that this construction establishes a relatively straight and unencumbered path for installation of heating, air conditioning, and ventilating ducts, plumbing, wiring, and other utilities which are customarily built concealed within walls, ceilings, and floors.

These modules enable expedited assembly of the building frame, while retaining conventional advantages of otherwise conventional wood framing. Also, with easier installation and reduced if not eliminated cutting of joists when installing ducts, plumbing, and wiring, costs of installing the ducts, plumbing, and wiring are reduced.

The novel modules contribute to structural integrity of the building frame, while accommodating expeditious and advantageous assembly of modules into the building frame, and enables economies to be realized when building the modules in a facility remote from the building being constructed.

Additional benefits accrue from the modules. One benefit is cost and weight per square foot of ceiling, floor, wall, and roof area. Compared to a traditionally framed floor module system, the novel modules save on both lumber costs and on weight. In an example wherein a novel module of nominal dimensions of twenty feet in length by eight foot in width is used in place of conventional framing, Applicant anticipates a material costs savings of seven and one half percent per module, and a weight savings of seven percent per module. Benefits appear to be particularly noticeable with floor depths using twelve inch nominal thickness joists, and increase if floor depths are further increased.

It should further be observed that the novel assembly concept enables modules to be built using a minimum of different lumber sizes. This reduces inventory and storage costs to the module manufacturer.

It is anticipated that standardizing layout of wall, floor, and roof modules as to top and bottom plates, and joists or rafters, costs of machinery, manpower, and factory spaced may be reduced by a factor of three, allowing additional savings over module costs set forth above.

Another benefit is that of improved sound proofing. It is anticipated that whereas a conventionally framed and insulated wall or floor system receives an expected Sound Transmission Class (STC) rating of 38, using novel modules where conventional twelve inch wide joists or roof rafters would be used yields an STC rating of 58.

Still additional benefits include improved thermal insulation performance. Because joists in the novel modules are provided in two vertically separated sections rather than one continuous joist (e.g., two two inch by six inch joists rather than one two inch by twelve inch joist), and with horizontal spacing as well, thermal and acoustic performance both increase.

The present invention provides improved elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

Figure 1:
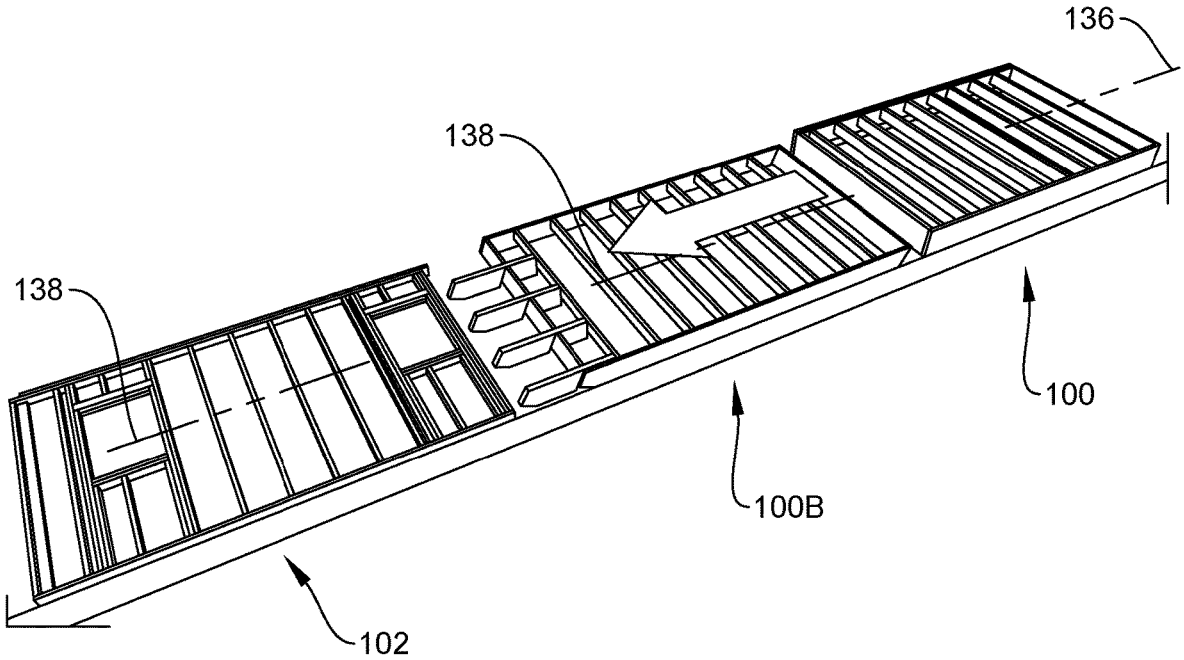
FIG. 1 is a perspective view of three types of modules arrayed to illustrate dimensional compatibility thereamong.

Drawings 1-13 drawn to internal scale, but not necessarily to external scale. By internal scale it is meant that the parts, components, and proportions thereof in the illustrated inventive example are drawn to scale relative to one another. As employed herein, external scale refers to scale of the illustrated example relative to scale of environmental elements or objects, regardless of whether the latter are included in the drawings. Where the inventive example claims external scale, the inventive and environmental elements may of course not be drawn to real or true life scale; rather, external scale signifies only that both the invention and environmental elements are drawn in scale to each other.

DETAILED DESCRIPTION

The present invention contemplates an advantageous arrangement of prefabricated modules to be incorporated into a wood frame of a building during construction of the latter. Referring first to FIGS. 1-5, according to at least one aspect of the invention, there is shown a module 100 for constructing a frame (not shown in its entirety) of a floor or a roof of a wood frame building structure (not shown). Module 100 comprises a bounded wood perimeter 106 (FIG. 2), upper joist boards 108 or upper roof rafters 108 (FIG. 2) coupled to bounded wood perimeter 106 at relatively high positions on the latter, and lower joist boards 110 or lower roof rafters 110 (FIG. 2) coupled to bounded wood perimeter 106 at relatively low positions on the latter. Within each module 100, each upper joist board 108 or upper roof rafter 108 has a lowermost edge 112 (FIG. 4) above a level of an uppermost edge 114 of each lower joist board 110 or lower roof rafter 110, with a gap 116 existing between lowermost edge 112 and every lower joist board 110 or lower roof rafter 110.

Bounded wood perimeter 106 comprises end boards 124 and top and bottom boards 120, 122. End boards 124 and top and bottom boards 120, 122 collectively establish perimetric bounds of all modules 100, 102, 104. An exception is modification to prefabricated modules 100, 102, 104 to accommodate a misfit between module size and remaining area of a frame remaining to be built. This situation occurs when a floor plan has a footprint area that does not jibe with area coverage of a whole number plurality of modules 100, 102, 104, and a portion of the frame must be custom built.

Figure 2:
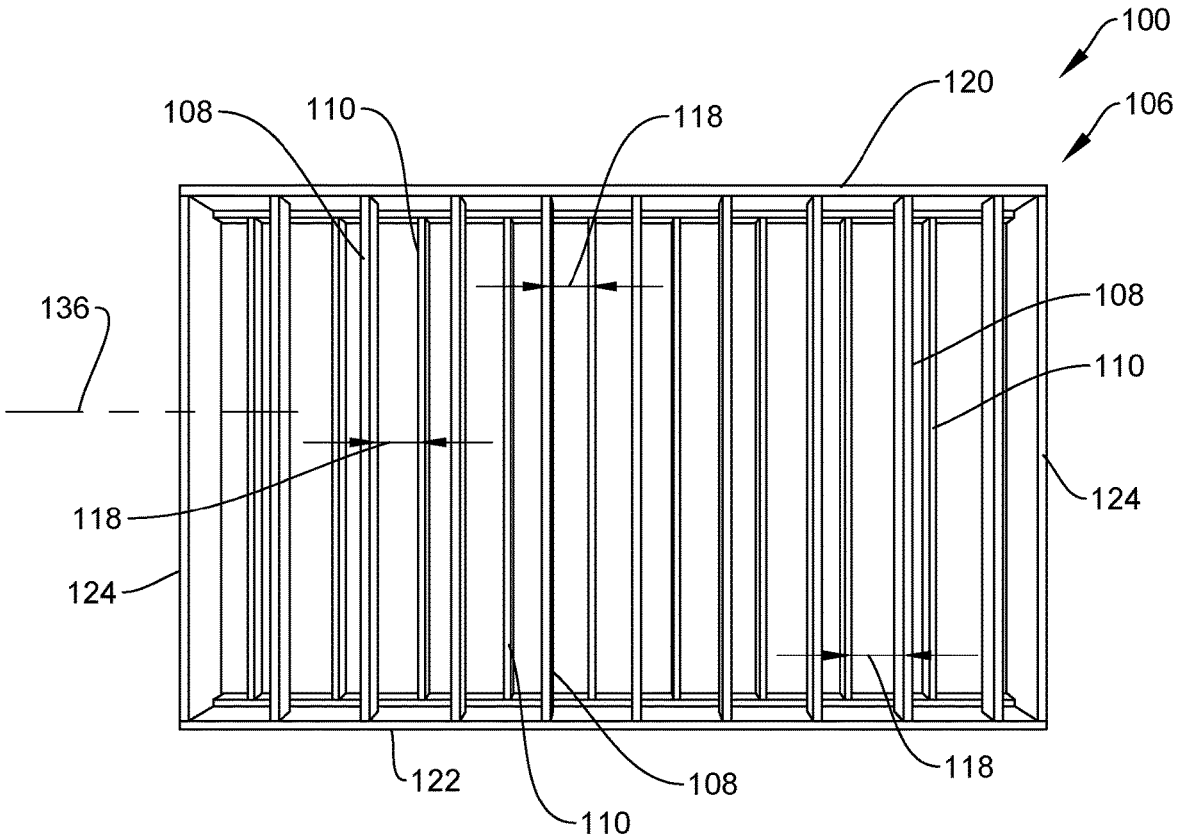
FIG. 2 is a perspective plan view of one type of module shown in FIG. 1.
Figure 3:
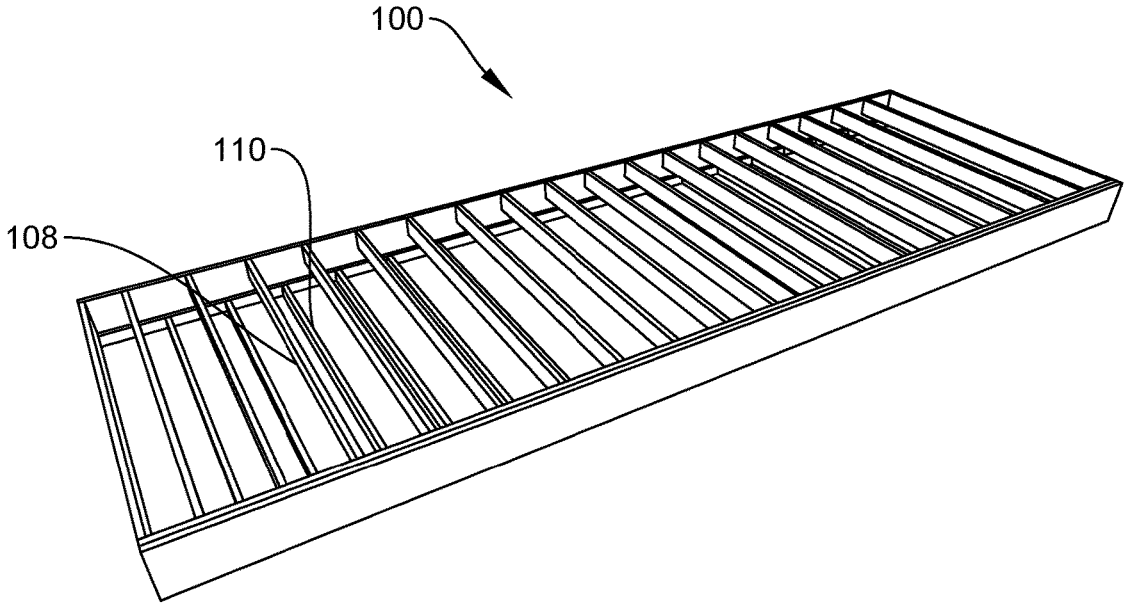
FIG. 3 is a perspective view of the module of FIG. 2.

Each upper joist board 108 or upper roof rafter 108 is staggered in plan view relative to lower joist boards 110 or lower roof rafters 110, as seen in FIG. 2. This is called out in FIG. 2 as a stagger gap 118. FIG. 3 shows module 100 at a viewing angle better enabling an observer to discern staggering of upper joist boards and roof rafters 108 relative to lower joist boards or roof rafters 110.

Figure 11:
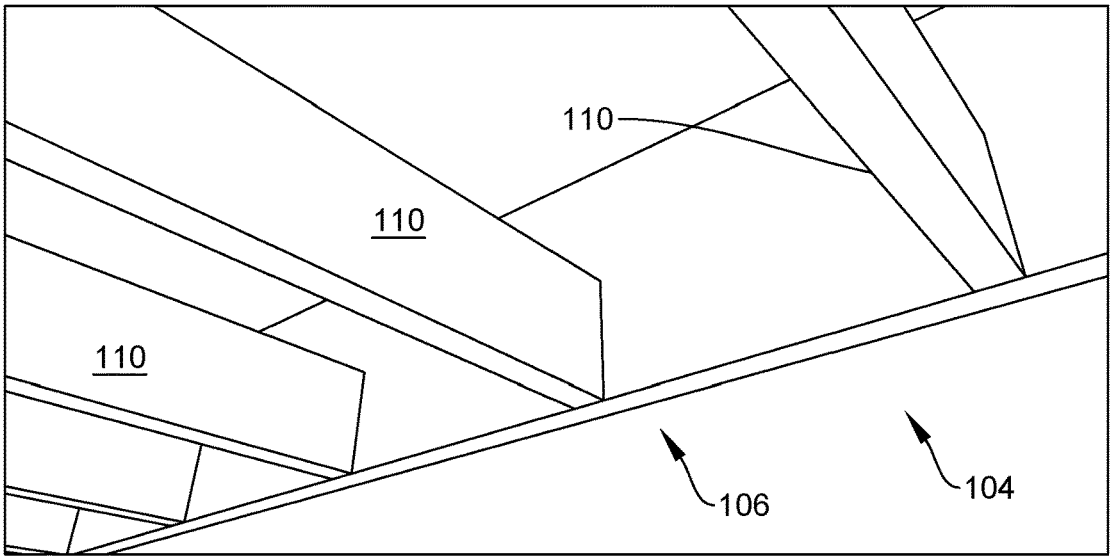
FIG. 11 is a partial bottom perspective view of a ceiling module.

Module 100 is usable as a floor module or as a roof module. Other modules usable with modules 100, as will be described hereinafter, include wall module 102 (FIG. 1) and ceiling module 104 (FIG. 11). It should also be noted that in any application of modules 100, 102, 104 (application refers to use of a module for a floor, roof, ceiling, or wall), each type of module 100, 102, or 104 may have variants. Examples of variants will be presented hereinafter.

Because of their structural and functional similarities, both upper joist boards and upper roof rafters are designated with the singular reference numeral 108. Similarly, lower joist boards and lower roof rafters are designated with the singular reference numeral 110.

Bounded wood perimeter 106 includes top and bottom boards 120, 122 (FIG. 2) and end boards 124 (FIG. 2).

It should be noted at this point that orientational terms such as upper, lower, high, and low refer to the subject drawing as viewed by an observer. The drawing figures depict their subject matter in orientations of normal use, which could obviously change with changes in posture and position of the novel modules. Therefore, orientational terms must be understood to provide semantic basis for purposes of description, and do not limit the invention or its component parts in any particular way.

Figure 5:
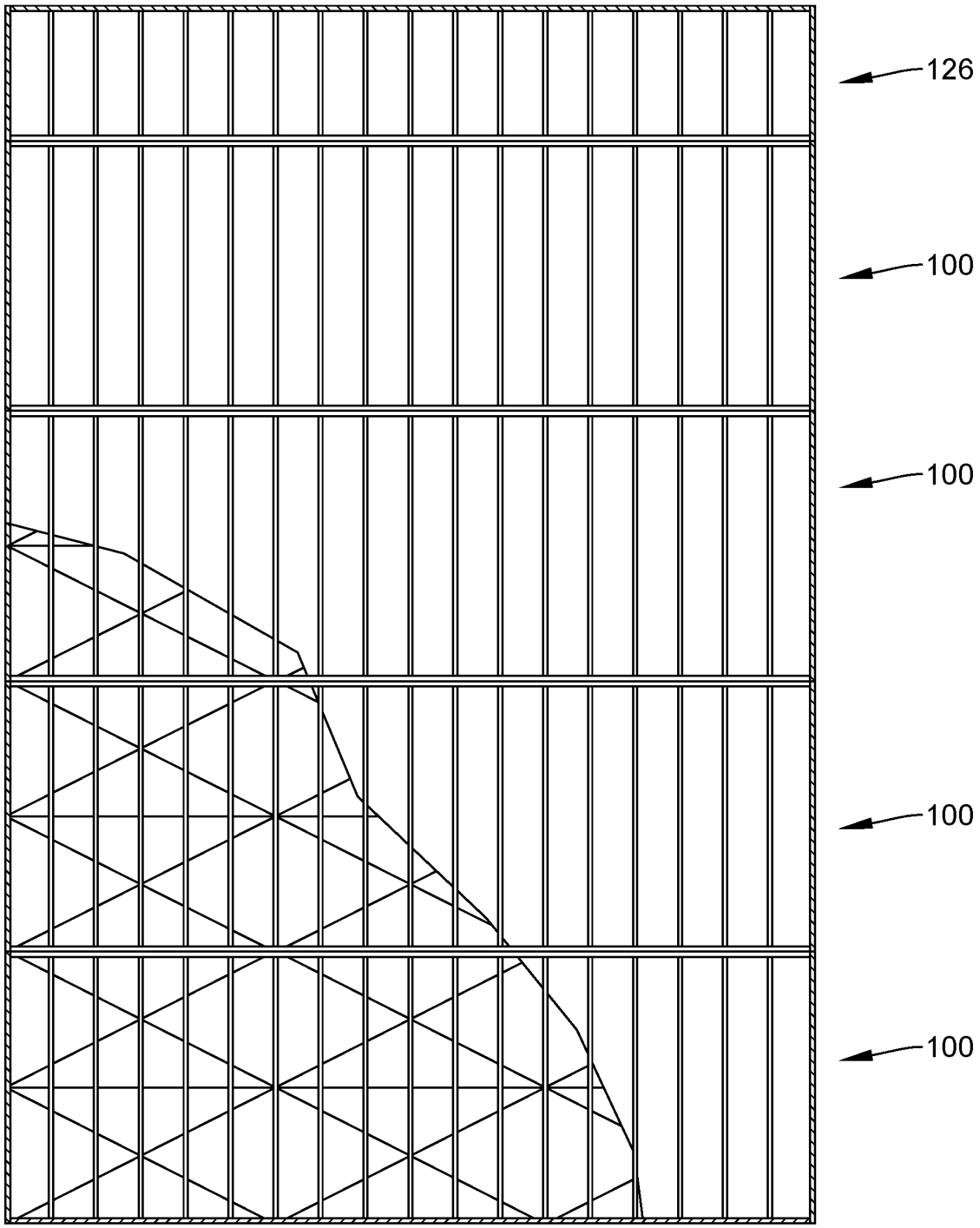
FIG. 5 is a top plan view of plural modules assembled together.

It will be seen in FIG. 2 that module 100 is rectangular in plan view. This is characteristic of modules 100, 102, and 104. Referring particularly to FIG. 5, typical building floor layouts use rectangular floor plans and combinations of and variations on rectangles. A rectangular module 100 readily accommodates rectangular floor plans, as seen in FIG. 5. FIG. 5 also illustrates another situation frequently encountered in building construction. That is, large modules (module 100 may be twenty feet long by eight feet wide, for example) will not fit evenly into any given floor plan. There will remain some space which must be custom framed. As seen in FIG. 5, completing the floor plan may require, if not building a frame for the nonconforming space by hand in the field, a customized or special module 126. Module 126 may be fabricated to appropriate dimensions in the facilities assembling modules 100, 102, 104. Alternatively, module 126 may be made by modifying a standard module 100. The latter approach will be particularly advantageous should module 126 account for half or less of the area of a standard module 100, 102, 104, since the removed portion may be used as the basis for a second special module 126. It is also possible that in buildings having a space to be custom framed may have more than one such space, each of different dimensions such that a standard module 100, 102, 104 may provide for two unequal special modules 126.

Figure 9:
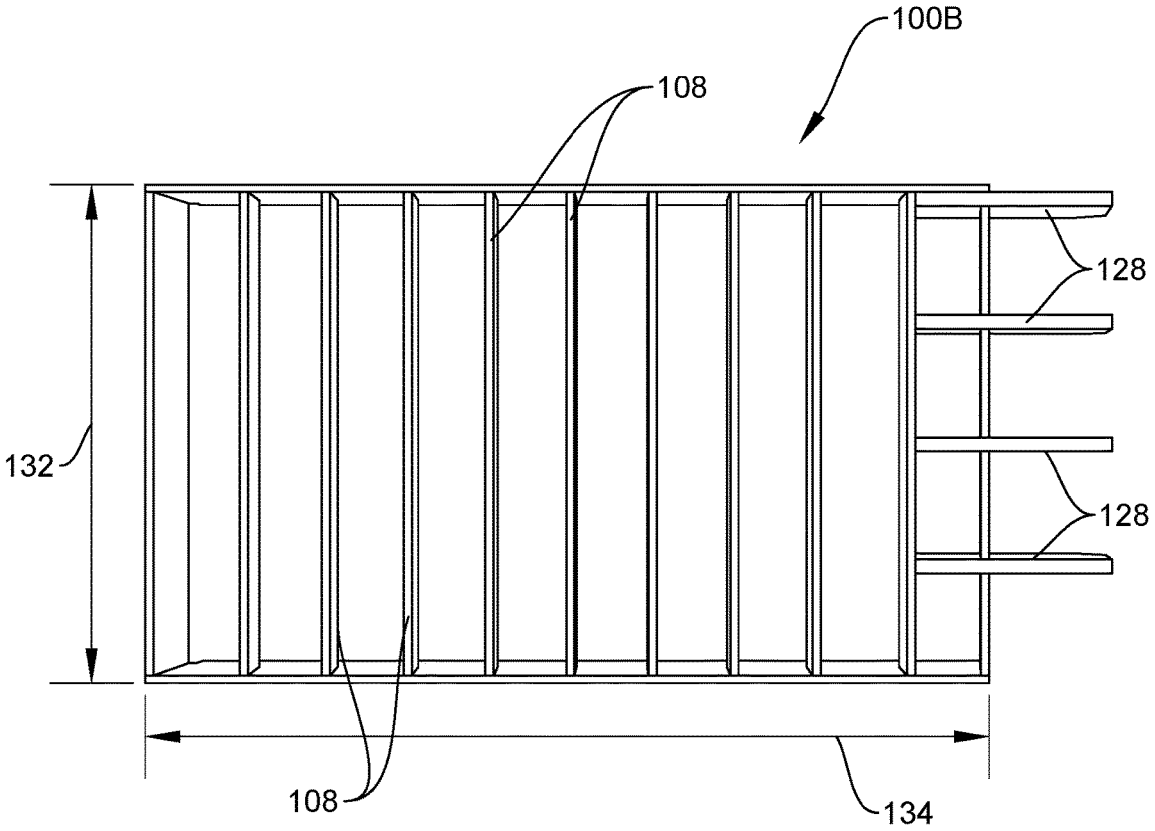
FIG. 9 is a top plan view of a floor or roof module, showing a variant thereof.

In another example where modules (e.g., module 100) do not coincide with a desired floor plan, a roof module 100B (FIGS. 1 and 9) is shown modified to further comprise at least one extension 128 extending outside bounded wood perimeter 106. Extensions 128 enable customized attachment in the field to nonconforming building structure (not shown). Roof module 100B retains other characteristics of modules of the novel system, such as bounded wood perimeter 106 and joists or rafters 108, and has retained a width 132. Overall length of roof module 100B is called out as 134.

Figure 6:
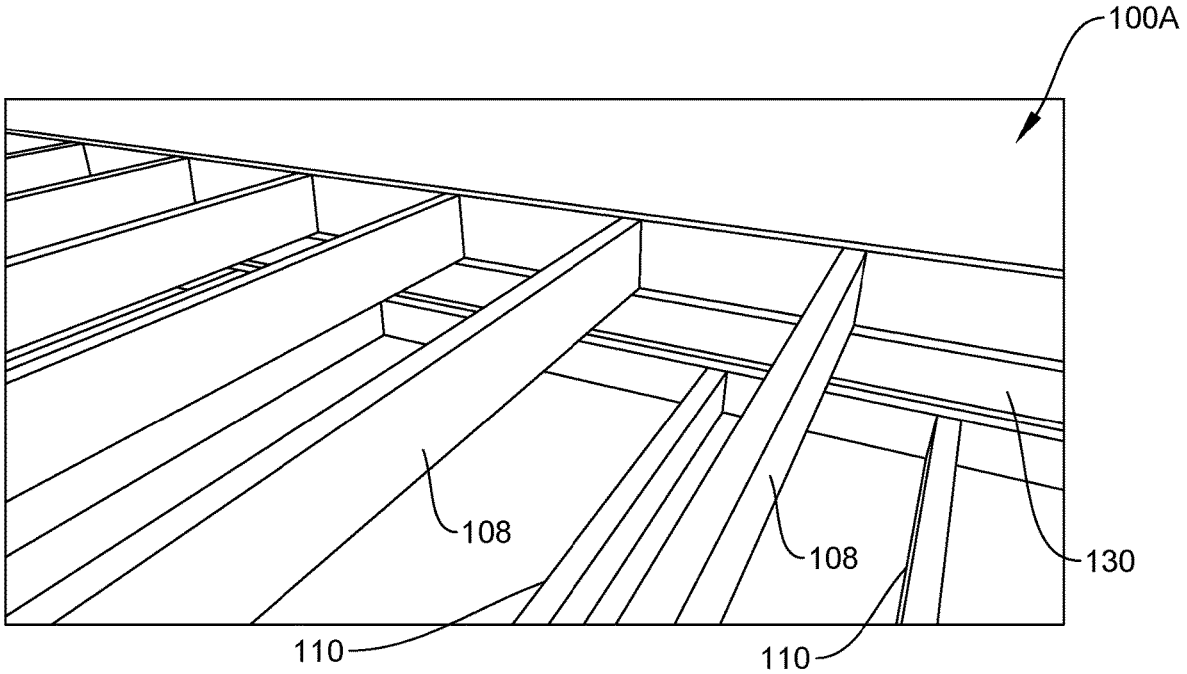
FIG. 6 is a top perspective detail view of a floor module of the type intended to support a ceiling module therebelow.
Figure 7:
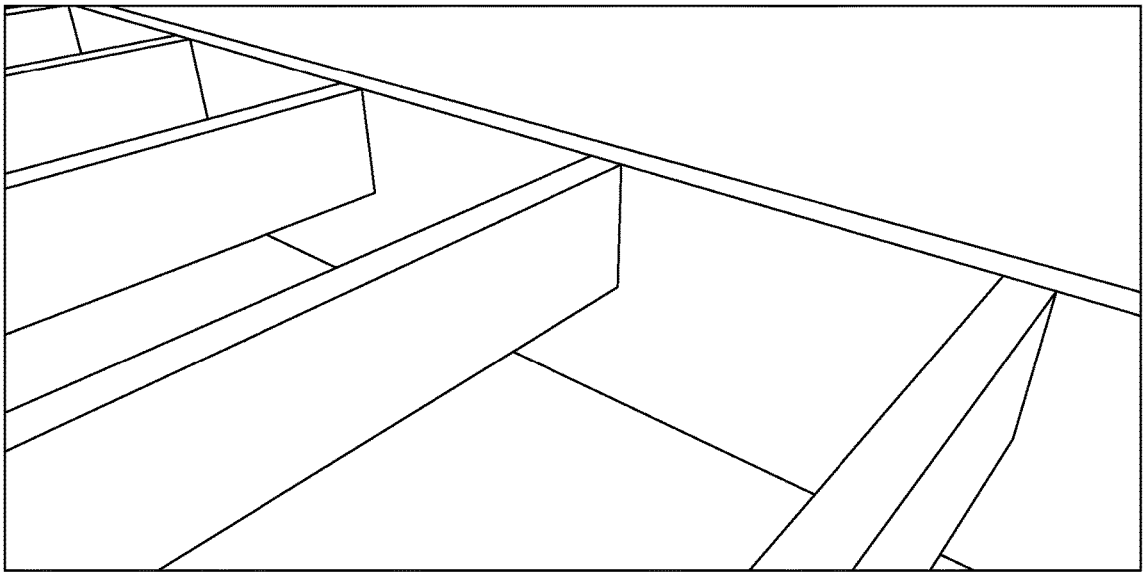
FIG. 7 is a top perspective detail view of a floor or roof module, where no ceiling module will be supported therebelow.
Figure 8:
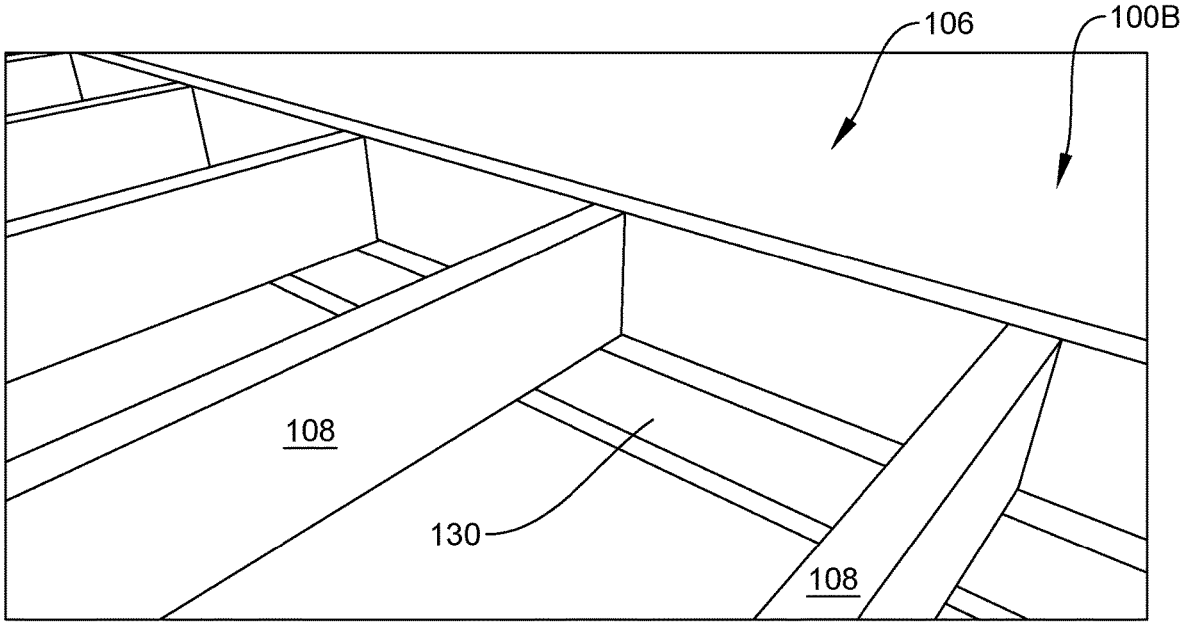
FIG. 8 is similar to FIG. 7, but shows incorporation of a ledger board.

Referring now particularly to FIGS. 6 and 8, respective modules 100A and 128 may be variants on standard modules (e.g., 100) incorporating a ledger board 130. In FIG. 6, floor or roof module 100A has upper joists or rafters 108 supported on ledger board 130. FIG. 8 shows a variant of floor or roof module 100. Notably, floor or roof module 100B has upper joist boards 108 supported on ledger board 130.

Figure 4:
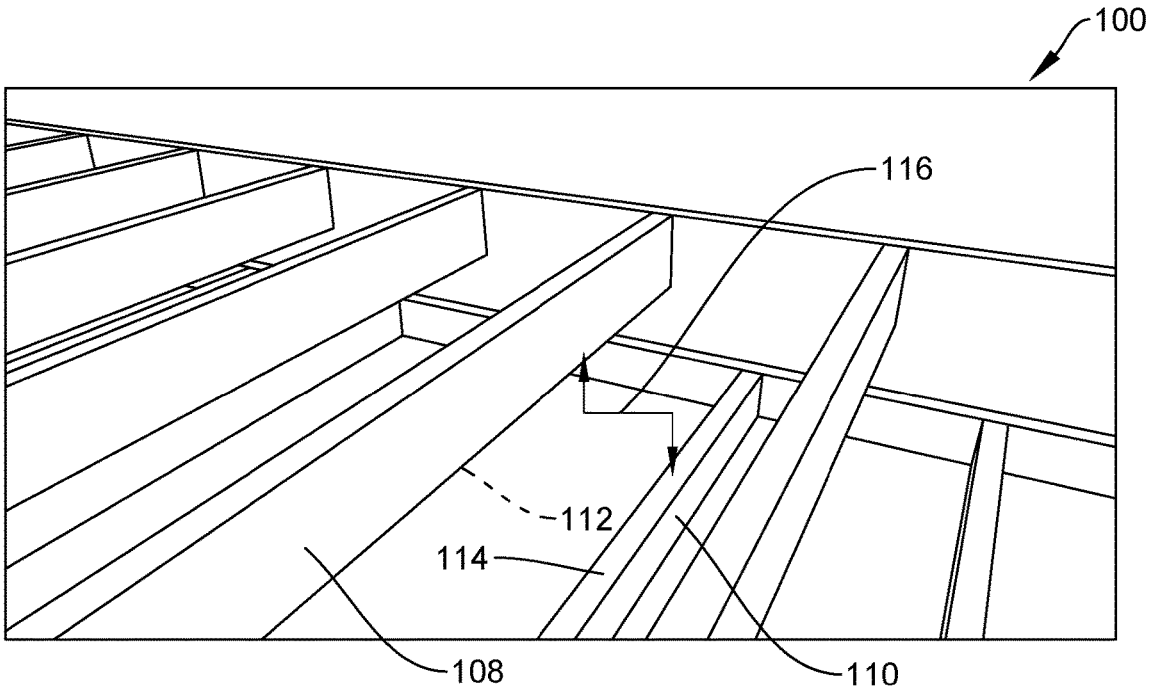
FIG. 4 is an enlarged perspective detail view of a variation on the module of FIG. 1.

The invention may be thought of as a system of modules (e.g., module 100) for constructing a frame of a floor, a ceiling, or a roof of a wood frame building structure. With particular reference to FIGS. 2-4, the system may comprise a plurality of first modules 100 for use in a floor or a roof First module 100 may comprise bounded wood perimeter 106 having a first longitudinal axis 136 (FIG. 2) and first dimensions of length 134 (FIG. 9) and width 132 (FIG. 9), upper joist boards 108 (FIG. 2) or upper roof rafters 108 coupled to bounded wood perimeter 106 at relatively high positions on the latter, and lower joist boards 110 (FIG. 2) or lower roof rafters 110 coupled to bounded wood perimeter 106 at relatively low positions on the latter. Within each first module 100, each upper joist board 108 or upper roof rafter 108 has a lowermost edge 112 (FIG. 4) above a level of an uppermost edge 114 (FIG. 4) of each lower joist board 108 or lower roof rafter 108. Gap 116 exists (FIG. 4) between lowermost edge 112 and every lower joist board 110 or lower roof rafter 110. Each upper joist board 108 or upper roof rafter 108 is staggered in plan view relative to lower joist boards 110 or lower roof rafters 100.

A plurality of second modules (e.g., 102, 104) for use in a wall or a ceiling, second module 102 or 104 comprising bounded wood perimeter 106 having a second longitudinal axis 138 (FIG. 1) and second dimensions of length 134 (FIG. 9) and of width 136 (FIG. 2). Second dimensions of length 134 and width 136 of second modules (102 or 104) are equal to the first dimensions of length 134 and width 132 of first modules 100.

Alternatively stated, modules 100 have staggering and gaps 116 (FIG. 4), 118 (FIG. 2), while other modules (e.g., 102, 104) may or may not have staggering and gaps 116, 118. All modules 100, 102, 104 will share overall length 134 and width 132, except where modified because standard factory manufactured modules 100, 102, 104 may be too large to fit within a remaining space of a floor plan after a certain number of modules 100, 102, 104 have been affixed to the building frame.

Figure 10:
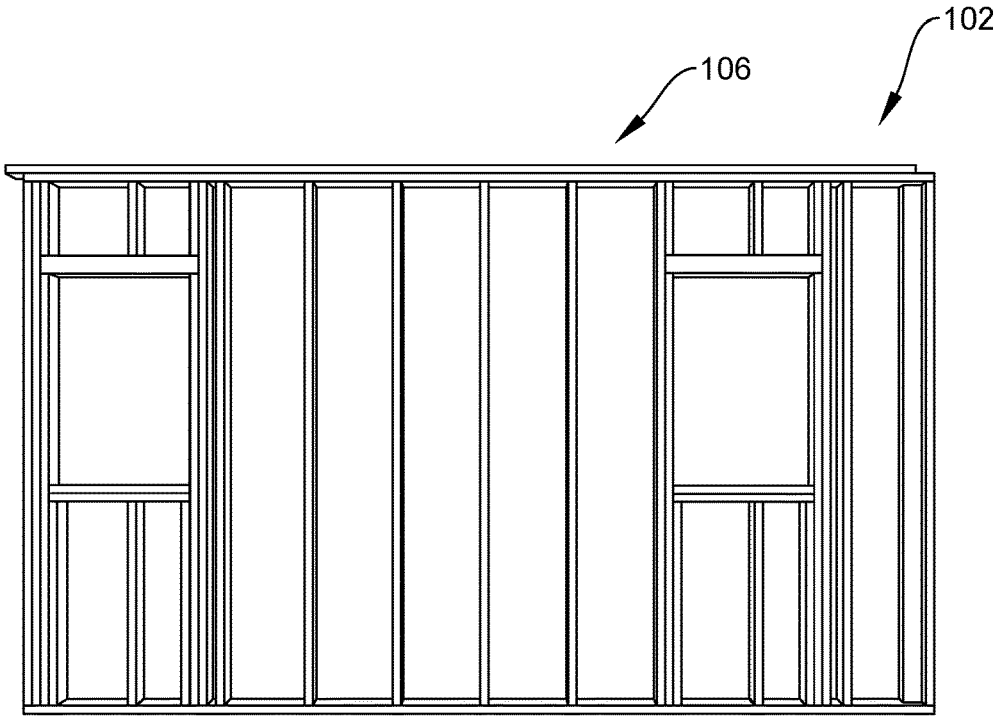
FIG. 10 is a side view of a typical wall module.

FIG. 10 shows a wall module 102 having length equal to other modules (e.g., modules 100 and 104) of the system. This assures that even though most of the structural features of wall module 102 may be conventional, wall module 102 may be fabricated the same way modules 100 and 104 are fabricated. Also, planning and labor of building assembly can be planned and executed expeditiously, without having to cope with a modular component different in dimensions than other modular components.

Figure 12:
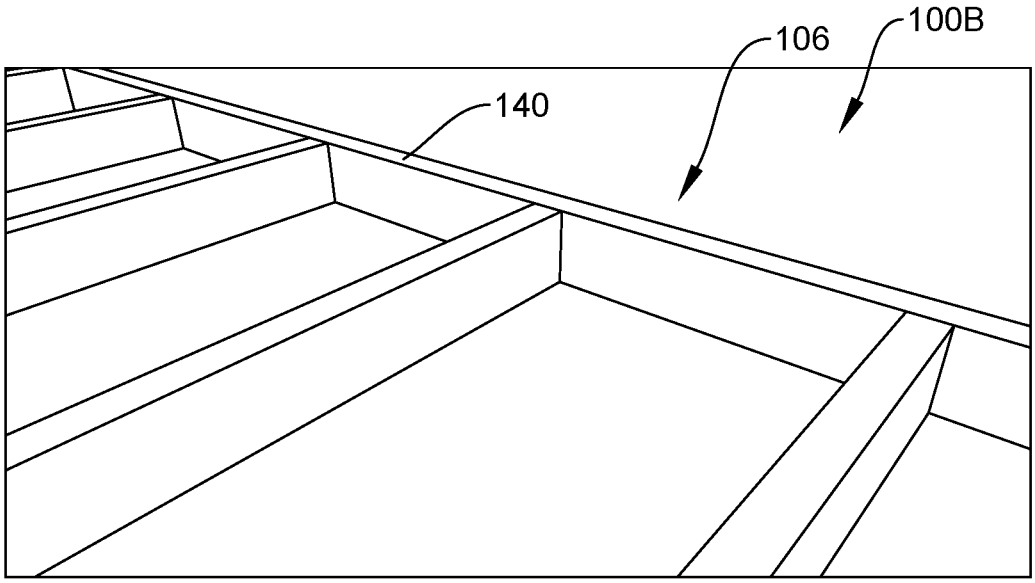
FIG. 12 is a top perspective detail view of a wall module, showing a singular bottom board.
Figure 13:
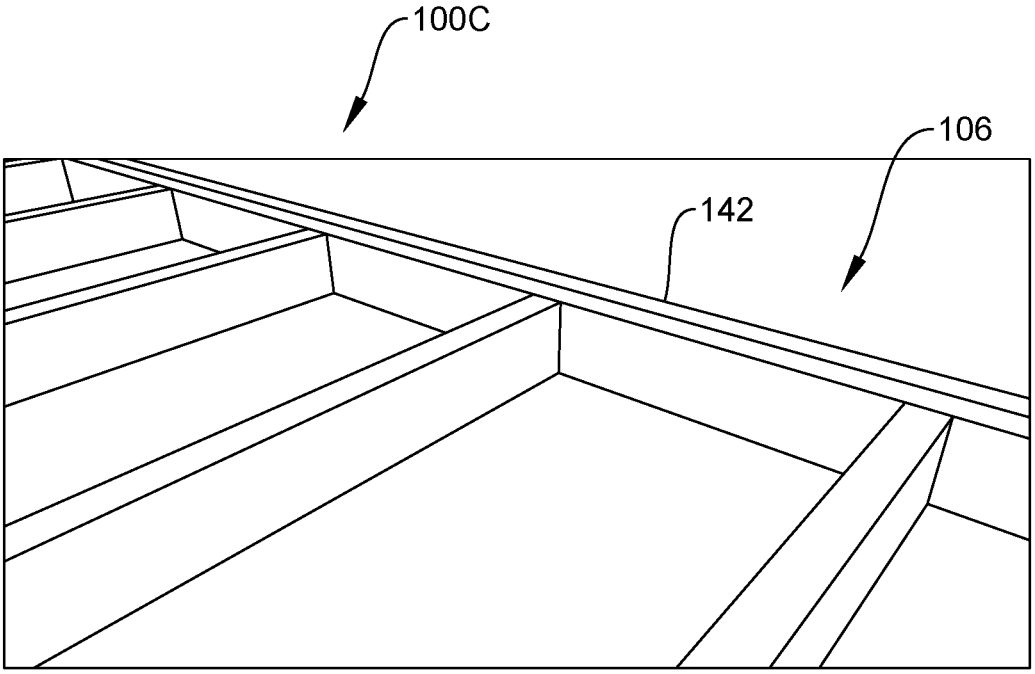
FIG. 13 is similar to FIG. 12, but shows a double bottom board.

Wall module 102 may have its variants. In FIG. 12, bounded wood perimeter 106 of wall module 100B has a single top board 140. By contrast, in FIG. 13, bounded wood perimeter 106 of wall module 100C has a double top board 142.

Unless otherwise indicated, the terms "first", "second", etc., are used herein merely as labels, and are not intended to impose ordinal, positional, or hierarchical requirements on the items to which these terms refer. Moreover, reference to, e.g., a "second" item does not either require or preclude the existence of, e.g., a "first" or lower-numbered item, and/or, e.g., a "third" or higher-numbered item.

In the system, at least one of second modules (e.g., 102, 104) includes structural members (e.g. joists or rafters) spanning opposed sides of bounded wood perimeter 106, the structural members extending perpendicularly to the second longitudinal axes 138 (FIG. 1) of their respective second modules.

Alternatively stated, at least one but not necessarily all second modules have structural attributes of modules 100, notably, corresponding to joists or rafters perpendicular to longitudinal axes 138 of their respective modules.

The invention may additionally be thought of as a method of constructing a wood frame building structure, the method enabling use of expeditiously fabricated modules (e.g., modules 100, 102, 104). The method may comprise fabricating a plurality of modules 100, 102, 104 including floor or roof modules 100, and wall modules 102 or ceiling modules 104, wherein each floor or roof module 100 comprises bounded wood perimeter 106, upper joist boards 108 or upper roof rafters 108 coupled to bounded wood perimeter 106 at relatively high positions on the latter, and lower joist boards 110 or lower roof rafters 110 coupled to bounded wood perimeter 106 at relatively low positions on the latter. Within each floor or roof module 100, each upper joist board 108 or upper roof rafter 108 has a lowermost edge 112 above a level of an uppermost edge 114 of each lower joist board 110 or lower roof rafter 110, with a gap 116 existing between lowermost edge 112 and every lower joist board 110 or lower roof rafter 110. Each upper joist board 108 or upper roof rafter 108 is staggered in plan view relative to lower joist boards 110 or lower roof rafters 110.

The method further comprises assembling at least a portion of the wood frame building structure using the modules 100 and at least one of modules 102 and 104.

Alternatively stated, the method uses novel floor or roof modules 100 shown in FIGS. 2-5, in combination with other modules (e.g., 102, 104), the latter optionally having or omitting novel features of floor or roof modules 100. In all cases, the other modules will have identical length 134 and width 132 dimensions as floor or roof modules 100.

The method utilizes modules 100, 102, 104 which as installed within the frame are rectangular in plan view. In the method, each module 100, 102, or 104 abuts another module 100, 102, or 104 when installed within the frame.

The method requires an arrangement or orientation of modules 100, 102, 104, wherein upper joist boards 108 or upper roof rafters 108 and lower joist boards 110 or lower roof rafters 110 of each module 100, 102, or 104 are parallel to upper joist boards 108 or upper roof rafters 108 and lower joist boards 110 or lower roof rafters 110 of every other module 100, 102, or 104 of any one application of modules.

In the method, at least one module 100, 102, or 104 may include at least one ledger board 130.

In the method, assembling at least a portion of the wood frame building structure using modules 100, 102, or 104 comprises assembling walls (not shown) from wall modules 102, where floor modules 100 and roof modules 100 (where used), ceiling modules 104 (where used) are coupled to the walls.

Where there is a discrepancy between dimensions of standard modules 100, 102, 104 and remaining space to be framed in a building under construction, the method may include using at least one module 100, 102, or 104 comprising at least one extension 128 extending outside bounded wood perimeter 106 of its associated module 100, 102, or 104.

While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

I claim:

1. A module for constructing a frame of a floor, a ceiling, or a roof of a wood frame building structure, the module comprising a bounded wood perimeter comprising a top board, a bottom board, a pair of opposed end boards, each board having pairs of opposed faces, opposed edges, and opposed ends, wherein the faces, edges, and ends define planes which are disposed perpendicularly to each other, wherein each of the opposed faces has greater two-dimensional area than each of the opposed edges, and each of the opposed edges has greater two-dimensional area than each of the opposed ends, a longitudinal axis running perpendicular to the faces of each of the opposed end boards and traversing a longitudinal measurement defined by the distance between the opposed end boards, the longitudinal measurement greater than the distance between the top board and bottom board, which latter distance is greater than a width of the bounded wood perimeter, upper joist boards or upper roof rafters coupled to the bounded wood perimeter at relatively high positions on the latter, and lower joist boards or lower roof rafters coupled to the bounded wood perimeter at relatively low positions on the latter, wherein within each said module, each of the upper joist boards or upper roof rafters, and lower joist boards or lower roof rafters have pairs of opposed faces, opposed edges, and opposed ends, the opposed edges comprising an uppermost edge and a lowermost edge, wherein the faces, edges, and ends define planes which are disposed perpendicularly to each other, wherein each of the opposed faces has greater two-dimensional area than each of the opposed edges, and each of the opposed edges has greater two-dimensional area than each of the opposed ends;

each said lowermost edge of said upper joist board or upper roof rafter is above a level of said uppermost edge of each said lower joist board or lower roof rafter, with a gap existing between the lowermost edge and every lower joist board or lower roof rafter, each said upper joist board or upper roof rafter is staggered in plan view relative to the lower joist boards or lower roof rafters; and each face of said upper joist board or upper roof rafter and each face of said lower joist board or lower roof rafter defines a plane which is parallel to a plane defined by the face of each of said opposed end boards;

wherein each face represents the widest surface of each joist board, each roof rafter, and each end board and such widest surface is oriented normal to the longitudinal axis of the bounded wood perimeter.

2. The module of claim 1, wherein said module is rectangular in plan view.

3. The module of claim 1, further comprising at least one ledger board.

4. The module of claim 1, further comprising at least one extension extending outside the bounded wood perimeter.

* * * * *